United States Patent [19]

Diamond et al.

[11] Patent Number: 4,993,846

[45] Date of Patent: Feb. 19, 1991

[54] SOFT BAG AND EXPANDER

[75] Inventors: Sidney Diamond, 3800 N. Lake Shore Dr., Apt. 11-B, Chicago, Ill. 60613; Deborah L. Diamond, Northbrook, Ill.

[73] Assignee: Sidney Diamond, Niles, Ill.

[21] Appl. No.: 523,734

[22] Filed: May 15, 1990

Related U.S. Application Data

[63] Continuation-in-part of Ser. No. 383,863, Jul. 21, 1989, which is a continuation-in-part of Ser. No. 367,759, Jun. 19, 1989, Pat. No. 4,946,292.

[51] Int. Cl.[5] ..... A45C 7/00

[52] U.S. Cl. ..... 383/127; 190/106; 383/33

[58] Field of Search ..... 383/33, 35, 104, 119, 383/127, 2; 190/103, 107, 105, 106; 206/805

[56] References Cited

U.S. PATENT DOCUMENTS

| | | | |
|---|---|---|---|
| 1,745,947 | 2/1930 | Mustin | 206/805 X |
| 2,798,579 | 7/1957 | Fox | 190/107 X |
| 2,930,557 | 3/1960 | Richards | 206/805 X |
| 3,447,648 | 6/1969 | Schwennicke | 190/103 |
| 3,902,541 | 9/1975 | Wardwell | 383/119 X |
| 3,934,803 | 1/1976 | Pauhs, Jr. | 383/33 X |
| 4,077,451 | 3/1978 | Zoland | 383/127 |
| 4,141,399 | 2/1979 | Zoland | 383/109 X |
| 4,142,564 | 3/1979 | Zoland | 383/127 |
| 4,434,894 | 3/1984 | Lee | 383/33 X |

*Primary Examiner*—Bryon P. Gehman
*Attorney, Agent, or Firm*—John S. Pacocha

[57] ABSTRACT

An expander for insertion into and expansion of a soft bag comprising a device which is folded or collapsed to a flat state or spread apart to an expanded state. The soft bag is collapsed to a compact form in the flat state for shipment. In the expanded position, the bag is expanded to give the appearance that it is filled. Some embodiments use a resilient member to automatically urge the device from a flat position to its expanded position when compressive forces are removed from the bag. Other forms use a cord for manually moving the expander device into its bag-expanding position. To provide for a greater extent of expansion in relation to the length of the device in the flat position, an expanding device having four sequentially arranged sections, each of which is articulatable with respect to each adjacent section is provided in some embodiments. Expansion of a cylindrical bag is facilitated by a generally rigid insert in certain embodiments that is articulatable to better conform to the curved shape to the side portions.

20 Claims, 11 Drawing Sheets

SOFT BAG AND EXPANDER

This is a continuation-in-part of pending U.S. patent application Ser. No. 07/383,863 filed July 21, 1989 which is a continuation-in-part of pending U.S. patent application Ser. No. 07/367,759 filed June 19, 1989, now U.S. Pat. No. 4,946,292.

BACKGROUND OF THE INVENTION

1. Field of the Invention

This invention relates to means for and methods of expanding at the point of sale of a soft bag, back-pack, or the like for display. More particularly, this invention relates to an apparatus which either automatically or manually expands a bag to give an impression that the bag is filled.

2. Background of the Invention

For convenience of expression in this application, the term "soft bags" is used to describe all suitable devices, such as suitcases, tote bags, sports bags, back-packs, barrel bags and the like, of all sizes and types.

These soft bags are presently manufactured throughout the world and transported from the manufacturer to the destination of sale in a flatly packed or nested state so as to take up minimal shipping space because the costs involved in shipping stuffed bags are prohibitive. Freight charges from the point of manufacture to the destination of the bags are usually based on the amount of space that the bags occupy. For example, twelve back-packs nested and shipped flat occupy the same amount of space (approximately one cubic foot) that is occupied by one stuffed back-pack. Since most retailers prefer to display these soft bags in an expanded condition, a retailer often arranges for the bags to be stuffed and repacked at a stuffing facility located near the final destination or in some instances at the point of sale. The bags are removed from their original shipping cartons at the stuffing facility where the stuffing is done manually with such materials as crumpled paper, stiff cardboard pieces or inflated vinyl shapes. The original shipping cartons are then disposed of and replaced by larger cartons that will hold the fully stuffed bags.

Stuffing soft bags takes time, space, and additional personnel, which increases costs, causes inconvenience and sometimes delays delivery of the product to the point of sale. Additionally, the original shipping cartons are not reusable or recyclable and, therefore, must be discarded, often requiring cartage companies, which charge a fee for waste removal and disposal at dump sites. Moreover, additional costs for the new larger cartons and additional freight charges are incurred for shipping the new cartons containing the stuffed bags to the retailer after the stuffing process is completed.

The retailer may confront storage problems since the stuffed bags take up much more space than unstuffed bags. Accordingly, the retailer may be inclined to order limited quantities of soft bags because of storage restrictions for fully expanded bags. Thus, there is a risk of a rapidly depleting inventory so that the retailer may be unable to reorder in time to fill the demand.

As a result of the problems associated with manually stuffed bags, some retailers have opted to display their bags while they are still flat and to include a picture of the bag as it appears when it is expanded. This method, however, is also costly and precludes the consumer from viewing the actual expanded bag.

Other retailers have contemplated having bags stuffed at the manufacturing point, but this is uneconomical because it requires more shipping space so that less bags can be shipped per container causing greatly increased shipping costs. Accordingly, an object of the present invention is to provide an insertable apparatus that permits a bag to be retained in a flattened state until expansion is desired and then allows the bag to be easily and quickly expanded by the retailer when the retailer desires to display the bag.

Another object of the present invention is to provide an insertable apparatus that is placed in the bag by the manufacturer or at the place of manufacture and is thereby more efficient and cost-effective since it allows the bag to be sent directly to the retailer, rather than to a stuffing facility, thus reducing delays in delivery time.

Another object of the present invention is to provide an insertable apparatus that requires minimum amount of material to manufacture and greatly reduces and conserves the usage of paper products or other stuffing materials, as well as the disposal of those materials.

Another object of the present invention is to provide an insertable apparatus that is placed in the bag during manufacture and then sent to the retailer in the original shipping container, in order to reduce freight charges and eliminate the need for an additional larger shipping container to house the stuffed bags.

Another object of the present invention is to provide an insertable apparatus which is relatively inexpensive to manufacture and which may be imprinted with advertising or other information directed to purchasers of the bag.

Additional objects and advantages will become apparent from the following description and the drawings.

SUMMARY OF THE INVENTION

One embodiment of the present invention comprises an apparatus having a relatively flat and foldable member, which may be connected to a resilient member of an actuating means. The flat member can be constructed of a suitably shaped piece (or pieces) of cardboard, corrugated board, or other suitable material, which is provided with at least one transverse foldline that divides the flat member into at least two sections. The flat member can be folded along the foldline to urge the two sections toward one another. The resilient member or actuating means can be a rubber band which is connected to the opposed ends of the flat member in substantially perpendicular relation to the foldline or axis about which the flat member is folded.

When the flat member is in its unfolded position, the rubber band is stretched. The memory of the resilient member thereby causes it to urge the ends of the flat member inward and this in turn causes the member to move into its folded position. Thus, the flat member will only remain in its unfolded position if a weight or some other external force is applied to it. When this apparatus is placed in a bag and no force is applied to the bag to retain the flat member in a flattened state, the member moves into its folded position, forms a gable, and pushes the sides of the bag outward to expand the bag. To insure more uniform expansion of the bag, generally rigid inserts, made of cardboard or other suitable material, may be added to the inventive apparatus. The inserts are placed on each side of the flat member in parallel relation thereto. When the flat member is folded into a gable it pushes against the cardboard inserts, which in turn push outwardly against the side of the bag. Since the inserts are preferably shaped to the dimensions of the sides of the bag, they will cause the bag to uniformly expand.

At the point of sale, the bag will automatically expand when it is removed from the shipping carton and the external force is removed from it. This saves time and promotes uniform expansion of each bag.

In another embodiment of this invention the flat member comprises three sections arranged in tandem: an elongated first section, a second section foldably attached to one end of the first section, and a third section foldably attached to the end of the second section which is opposite the end attached to the first section. The second and third sections are connected together with a resilient member, which is attached adjacent the ends of the sections and urges the sections toward one another in a manner similar to the first embodiment described earlier. An alternative of this embodiment employs an actuating means, such as a string, tape, or other suitable item, to pull the second and third sections toward one another. The string attaches to one end of the third section, passes through an aperture near the opposite end of the second section, and extends outside the mouth of the bag in which the apparatus of this invention is inserted. When expansion of the bag is desired, one may simply pull on the string. This in turn pulls the third section in the direction of the pulling force and causes the second and third sections to fold about the foldline dividing them and form a gable. The gable pushes the bag sides apart, causes air to be drawn into the bag, and thereby expands the bag. In both embodiments, a tab on the end of the third section may be provided for insertion into a slot on the first section when the structure is in its gabled bag-expanding position. This tab and slot arrangement provides stability to the structure and prevents retrograde movement. Also, if several slots are used the height of the gable may be adjusted to accommodate different sized bags. Similar to the first embodiment, additional flat inserts can be used with the apparatus to promote more uniform expansion of the bag.

Other embodiments of the invention achieve expansion of the bag without the need for forming a gable. In one example, three separate piece parts interrelate. Two of the pieces are relatively flat, rigid panels or boards that are adapted to press against the sides of bags. The other piece is disposed between the other two boards and functions as an actuator to push the two boards apart. This actuator may be a panel with at least one tab on each end, each of which fits into at least one corresponding slot in the adjacent outer panel. The actuator may operate either automatically under the urging of a resilient member, such as a rubber band, attached to the actuator, or manually with a string or cord attached to the actuator. When the assembly is in its flattened, compressed position with rubber bands stretched or the string slack, all of the pieces are flat.

When the resilient member or string cause the actuator to move, the actuator will become upright, push the two panels apart against the sides of the bag, and eventually lock in an erect expanded position when the tabs enter the appropriate slots.

The inventive apparatus can be easily inserted into the bags at the point of manufacture. When the resilient member is used, the bag can be shipped closed. When the string is used, a slight opening in the bag mouth is preferably, through which the string may extend. When the inventive apparatus is used, the bags need not be shipped to a stuffing facility near their final destination, thereby saving labor, stuffing and repacking costs, and eliminating delays in delivery and material waste. Since the bags containing the inventive device can be shipped flat, there is no appreciable increase in freight costs or the size of the shipping container. Moreover, the inventive device saves paper since less material would generally be used in the inventive device as compared with the material used in manually stuffing of the bags. The inventive device also eliminate the need for repacking and placing the bags into a second larger shipping container.

Because soft bags come in different sizes, shapes and materials thicknesses, the inventive apparatus can be varied to accommodate these differences. As may be appropriate or desirable in each application, the various flat members or panels may be constructed in different lengths, widths, shapes, strengths including elliptical, rectangular, or irregular shaped.

For some soft bags, particularly those having a greater width or depth than length, it is desirable to have an expanding device that provides a greater extent of expansion in relation to the length of the device in its initial, collapsed flat position than can be obtained from expansion of a single gable forming piece or a single planar panel. Such a greater extent of expansion is provided by an expandable piece having at least four sections with each section being foldably attached to each of two adjacent ones of the sections for articulation relative to each other. Two or more of the adjacent ones of the sections form a first set of sections and two or more of the adjacent ones of the sections, not forming the first set of sections, form a second set of sections. The expandable piece is articulatable between an initial collapsed position in which the two or more adjacent ones of the sections forming the first set are in a substantially flat coplanar position and at least partially overlap the two or more adjacent ones of the sections forming the second set which are also in a substantially flat coplanar position and a fully expanded position in which sections of the first set are in a substantially parallel relation to each other and sections of the second set are in a substantially parallel relation to each other.

As in the other embodiments, a member is attached to at least one of the sections such that tension on the member urges each set of two or more adjacent ones of the sections from its respective, substantially flat coplanar position to an intermediate position in which the sections of each set are at an angle to each other and are restrained by the predetermined shape of the expanded compartment of the soft bag. Generally rigid inserts are provided for use in cooperation with the expandable piece for more uniform expansion of the soft bag and a smoother appearance of the bag in the expanded, substantially stuffed state. Tabs extending out from the expandable piece help maintain a particular relation between the expandable piece and the generally rigid inserts. Slots are provided in some of the generally rigid inserts to receive the tabs to better maintain the particular relation between the expandable piece and the generally rigid inserts.

When the predetermined shape of the compartment of the soft bag is a generally rectangular solid, generally rigid inserts that are generally planar work well. However, for bags having a curved configuration in the expanded, substantially stuffed state, such as cylindrical or barrel bags, it is desirable to modify the generally rigid inserts so that they are articulatable to better conform to the predetermined shape of the compartment. Each of two separate inserts may be provided with articulated segments so that each tends to conform to an arcuate shape. Alternatively, a single generally rigid insert may be provided with a sequential series of articulated segments such that the generally rigid insert may be expanded from an initial collapsed state in which it is formed of two generally planer overlapping parts to a generally U-shaped configuration.

BRIEF DESCRIPTION OF THE DRAWINGS

For a better understanding of the present invention, reference may be had to the accompanying drawings in which.

DETAILED DESCRIPTION OF THE INVENTION

Figure 1:
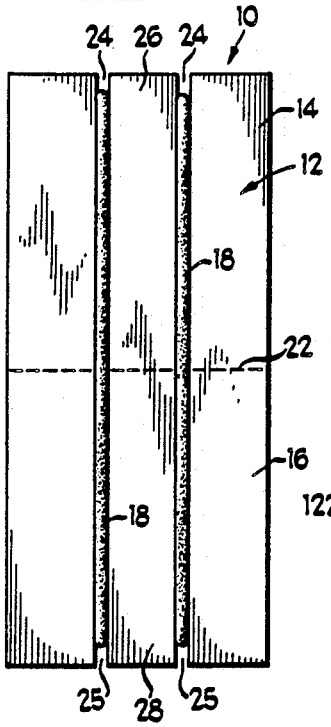
FIG. 1 is a bottom plan view of one embodiment of the invention, showing it in a flat position prior to insertion in a bag.
Figure 2:
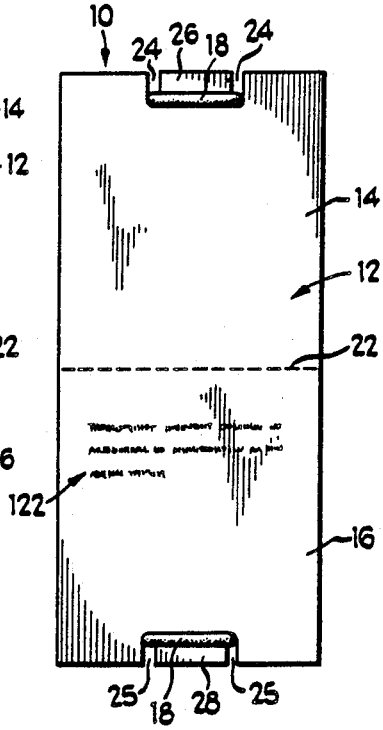
FIG. 2 is a top plan view of the embodiment of FIG. 1.
Figure 3:
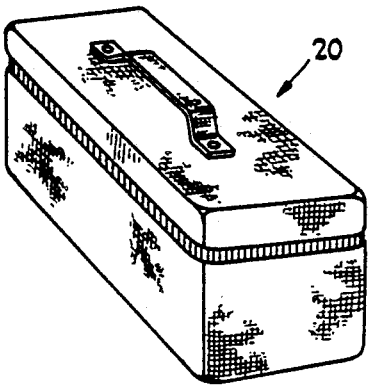
FIG. 3 is a perspective view of an exemplary soft bag as it appears after it is expanded by the inventive device.
Figure 4:
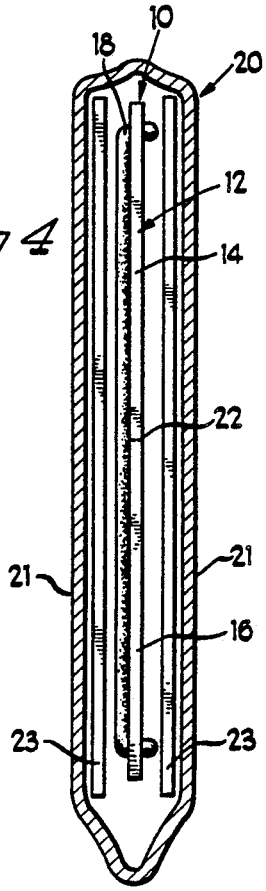
FIG. 4 is a cross-sectional view of the bag of FIG. 3 in a collapsed state, showing the embodiment of FIG. 1 in a flat position inside the bag.
Figure 5:
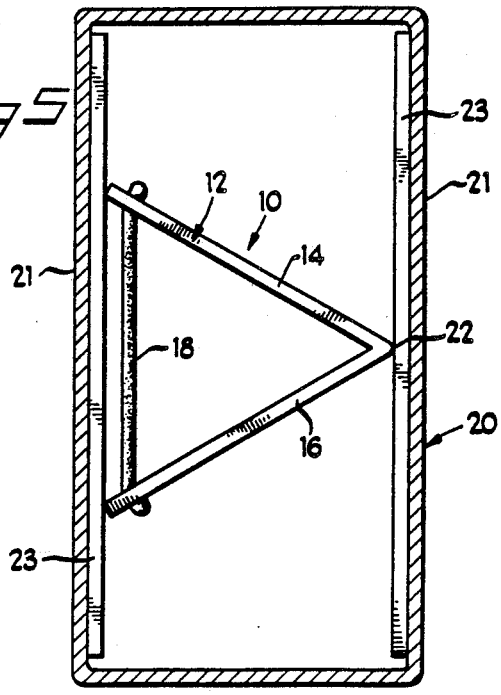
FIG. 5 is a cross-sectional view of the bag of FIG. 3 in an expanded state, showing the embodiment of FIG. 1 expanding the bag.

Referring to FIGS. 1-5, expander apparatus 10 comprises a generally flat member 12 and a resilient member 18 attached thereto. The flat member can be constructed of cardboard, corrugated board or of other suitable material by die cutting or other suitable manufacturing process. A foldline 22 is provided which divides member 12 into two preferably equal sections 14, 16 and permits member 12 to be folded along the line 22, which acts like a hinge, as shown for example in FIG. 5. The resilient member, which can be a rubber band or other elastic means, is attached to the first member by insertion into slots 24, 24 and 25, 25 and loops around tabs 26, 28 (FIGS. 1 and 2). When the member 12 is flat, the resilient member 18 is stretched and under tension. The memory of the member 18 causes it to urge the two sections 14, 16 of first member 12 towards one another. Thus, to keep the member 12 from folding along line 22, it is necessary to exert a force against member 12. When the apparatus 10 is inserted into a soft bag 20, as shown in FIG. 5, and the compressive force is removed from the bag, resilient member 18 causes sections 14, 16 to rotate about foldline or hinge 22 and move towards one another to form a gabled position. This in turn pushes cardboard inserts 23 apart and forces the sides 21 of bag 20 outwardly so that the bag expands. The cardboard inserts 23 are inserted into bag 20 on opposite sides of the member 12 (see FIG. 4) so that the inserts 23 are parallel to member 12. When the bag is expanded, as shown, e.g., in FIG. 5, the inserts 23 aid the bag 20 to expand uniformly.

Inserts 23 may be shaped and dimensioned to the bag in which they are to be used. This will normally give the best appearance to the bag when it is expanded. The inserts may also be provided in predetermined stock sizes as a matter of convenience and economy. The inserts can be eliminated in certain applications, such as small bags, or where the irregularities in the shape of the bags caused by the absence of the inserts is of no concern to the retailer.

During shipment from the manufacturer to a customer, soft bag 20 may be placed flat in a shipping container with other bags for shipment to retailers. The container normally will be completely filled with bags to maximize shipping space so if the bags contain the apparatus of this invention, the apparatus will be in a compressed state, as depicted in FIG. 4. When the bags are removed from the container, the compressive force will be relieved and the sections 14,16 of apparatus 10 will move towards one another, pushing the walls of the bag outwardly, as shown in FIG. 5, and giving the bag a filled appearance. To increase the speed of expansion the bag may be opened slightly to allow air to enter into the bag.

FIGS. 6-9 show a second embodiment or expander 11, including a generally flat member 30 comprising three sections 32, 34 and 36 and a resilient member 38.

Figure 9:
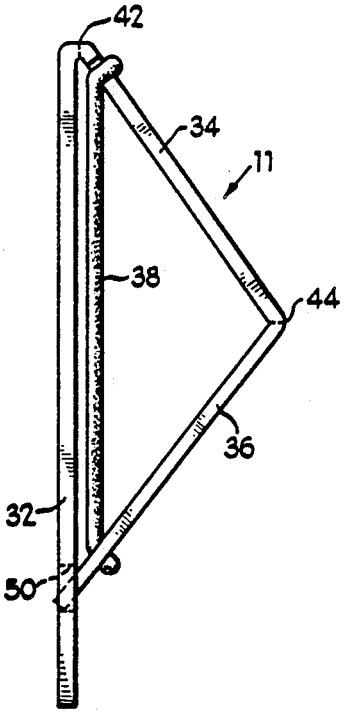
FIG. 9 is a side view of the embodiment of FIG. 6 showing the apparatus in a bag-expanding position.
Figure 6:
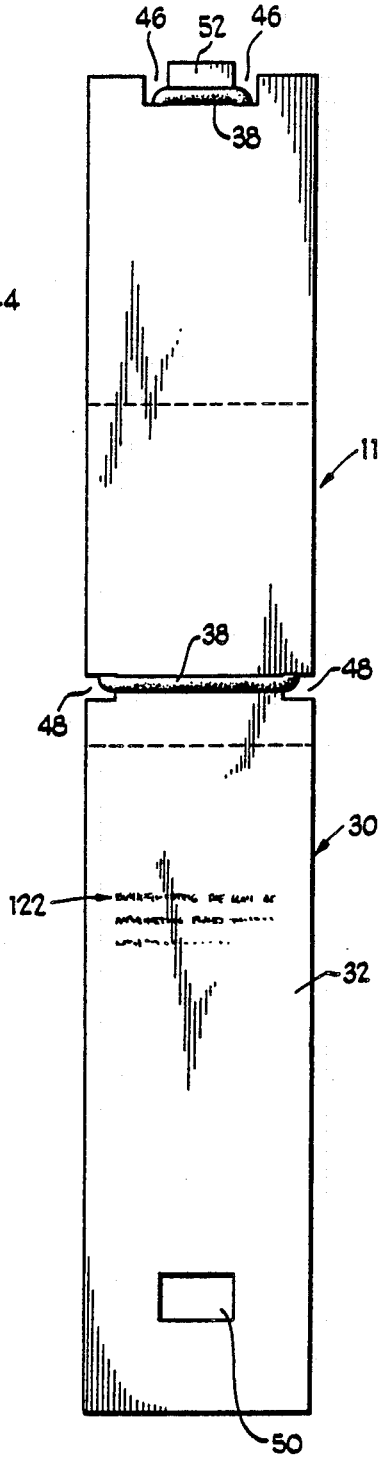
FIG. 6 is a top plan view of a second embodiment of the invention, shown in a flat unfolded position.
Figure 7:
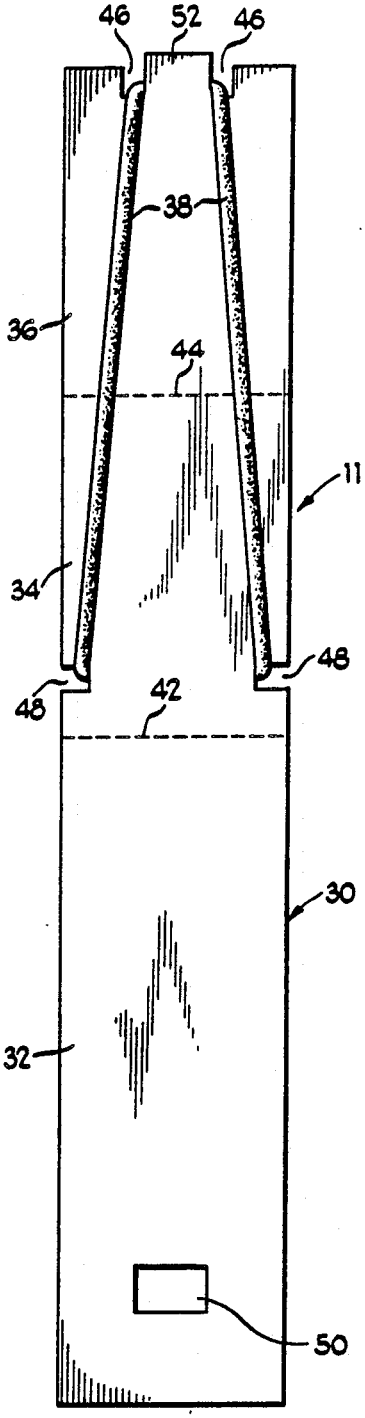
FIG. 7 is a bottom plan view of the embodiment of FIG. 6.
Figure 8:
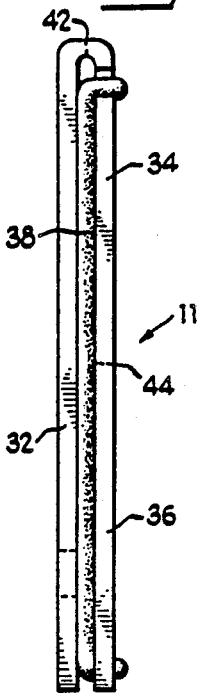
FIG. 8 is a side view of the embodiment of FIG. 6 illustrating the apparatus in a folded position with the resilient means stretched and under tension prior to insertion into an unexpanded bag.
Figure 12:
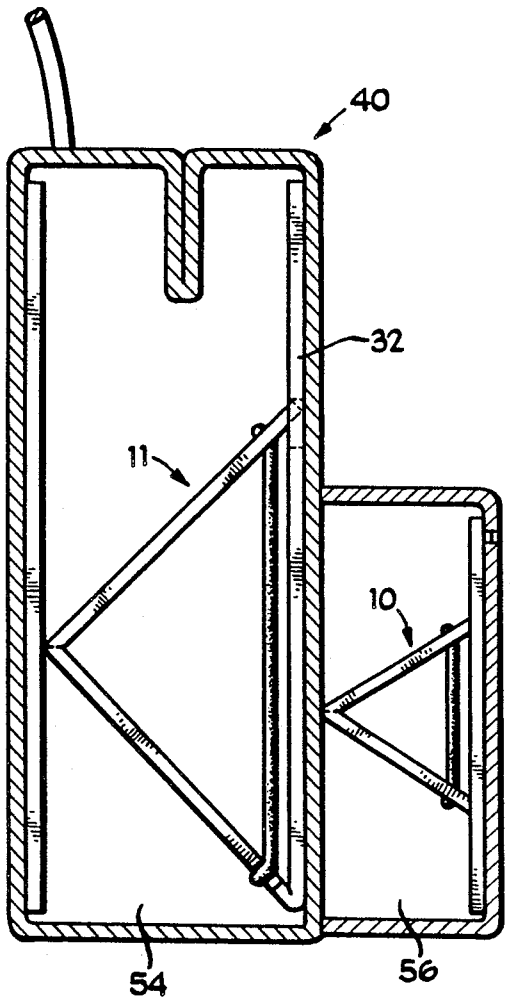
FIG. 12 is a cross-sectional view showing the embodiments of FIGS. 1 and 6, inserted into and expanding the two sections of the back-pack.

Sections 32, 34 and 36 are formed by folding member 30 along foldlines 42, 44. Slots 46, 48 are provided in member 30 for receiving and retaining member 38, as shown in FIGS. 6 and 7. To prepare the embodiment 11 for use in the bag, the member 30 is folded about foldline 42, as shown in FIG. 8. In this position resilient member 38 is stretched. So long as external compressive pressure is applied to the embodiment 11, it will be retained in the manner shown in FIG. 8. When the compression pressure is released, the sections 34 and 36 will be folded about hinge or foldline 44 and pulled together by the resilient member 38 to form a gable, as shown in FIG. 9.

Member 30 includes a slot 50 located on section 32. Slot or keeper 50 receives tab 52 located on section 36 and secures sections 34, 36 in the gabled position, shown in FIG. 9. This acts as a locking means and affords greater stability to the structure. The locking means prevents retrograde movement upon application of compressive forces. Should it be desired to collapse the structure, the tab 52 can be lifted from 50 and compressive forces applied to flatten the sections. As in the first embodiment, cardboard, corrugated board, or other suitable material may be used for member 30, and rubber bands or other suitable elastic means, for member 38.

Figure 11:
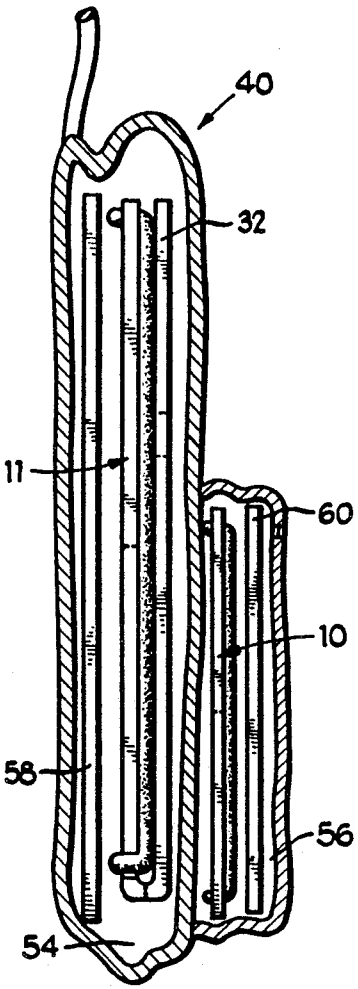
FIG. 11 is a cross-sectional view of the back-pack of FIG. 10 in a collapsed state, illustrating the embodiments of FIGS. 1 and 6, inserted in flat positions in the back-pack.
Figure 10:
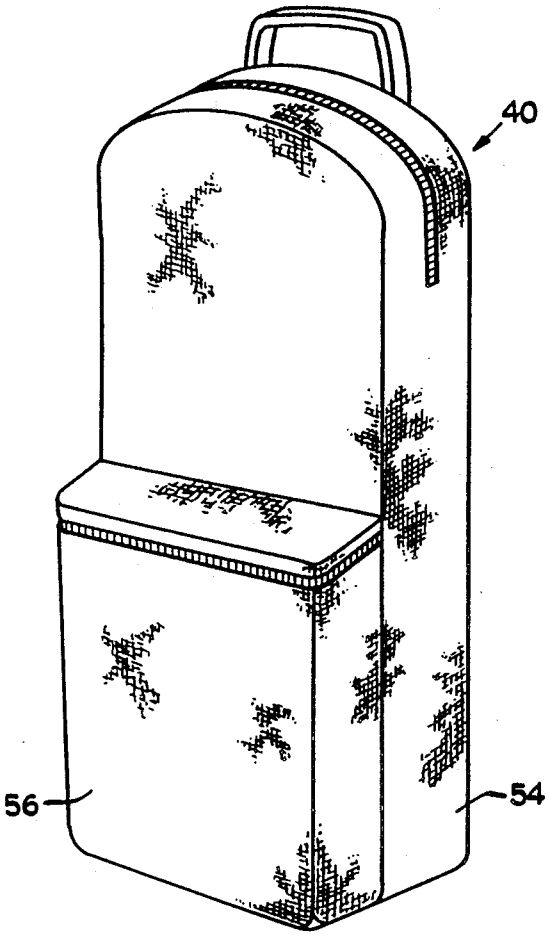
FIG. 10 is a perspective view of a back-pack with a pocket.
Figure 13:
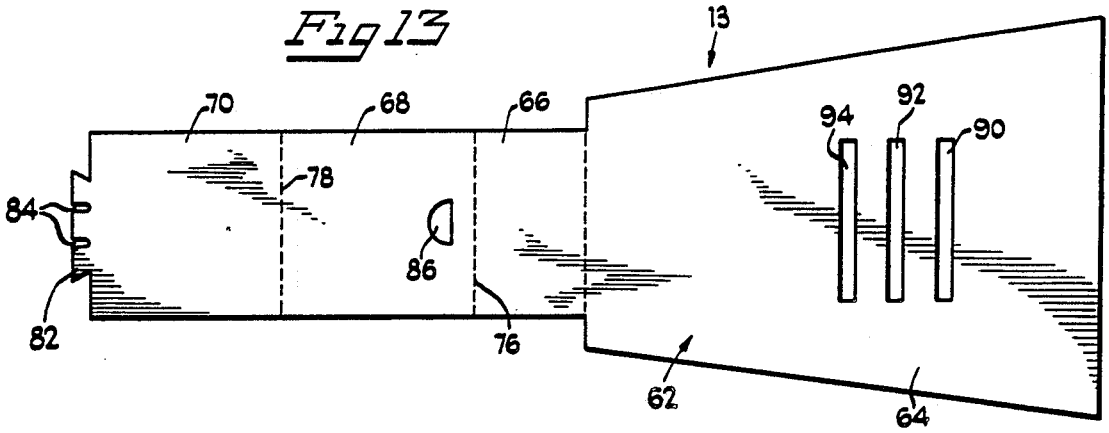
FIG. 13 is a plan view of a third embodiment of the invention, shown in an unfolded position.
Figure 14:
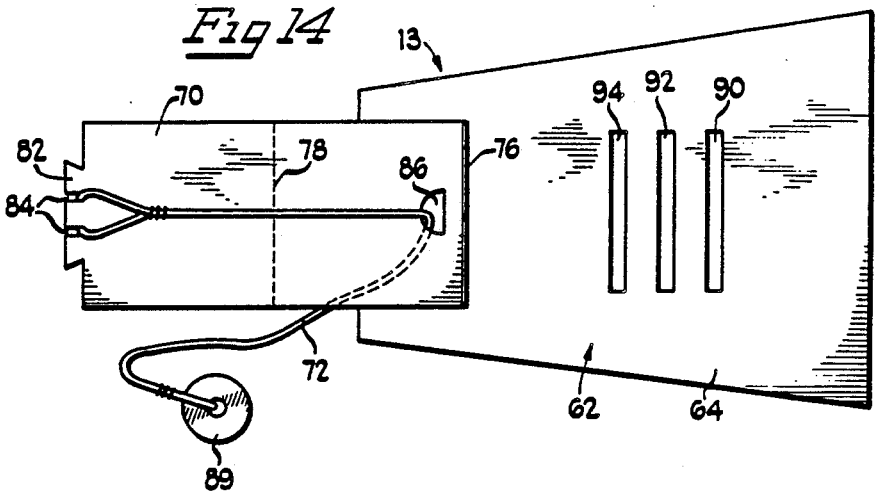
FIG. 14 is a plan view of the embodiment of FIG. 13 showing it in a partially folded position.

FIG. 10 shows a back-pack 40 with two separate compartments 54, 56. FIG. 11 shows embodiments 10 and 11 as they would appear in a flattened configuration in the compartments 56 and 54, respectively. A single cardboard insert 58 is added to compartment 54, and a single insert 60 is added to compartment 56 of the bag 40. As in the other embodiments, these inserts assist in uniform expansion of bag 40. Because of the three-section configuration of embodiment 11, only one additional insert is necessary. Also, as can be seen in FIG. 11, only one insert is necessary for compartment 56 because section 32 of embodiment 11 accomplishes the function of an insert for that compartment, as well as compartment 54.

FIGS. 13-16 show a third embodiment 13 of the invention. Apparatus 13 has a generally flat member 62 comprising four sections 64, 66, 68 and 70 and an actuator member 72, which can be a string, tape, or other suitable device. The actuator member 72 need not be elastic, but should be long enough, so that when apparatus 13 is inserted into a bag, member 72 will extend out from the mouth of the bag.

Figure 15:
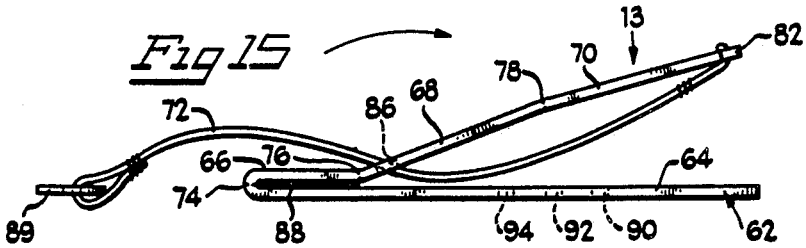
FIG. 15 is a side view of the embodiment of FIG. 13 showing the relative movement of the parts and their relationship to one another just prior to the insertion into a bag.
Figure 16:
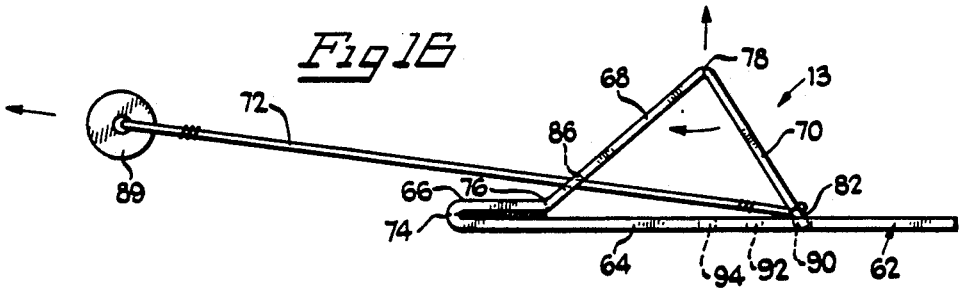
FIG. 16 is a side view of the embodiment of FIG. 13 showing further movement of the parts and their relationship to one another when the apparatus is actuated into its position for expanding a bag.
Figure 17:
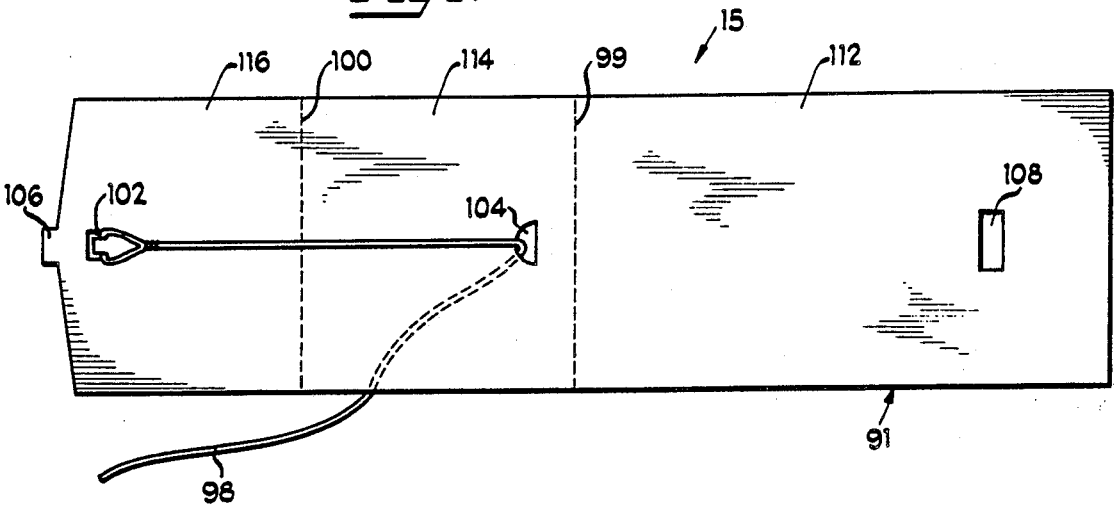
FIG. 17 is a plan view of a fourth embodiment of the invention showing it in an unfolded position.

The four sections 64, 66, 68, 70 are formed by foldlines 74, 76 and 78, and are adapted to fold over onto section 64 (see, e.g., FIGS. 15 and 16). Section 66 is secured to section 64 at point 88 by an adhesive, adhesive tape, or other suitable fastenings means (FIG. 15). Section 64 includes a plurality of slots 90, 92, 94, which are adapted to receive tab 82 of section 70. Tab 82 includes slots 84 which retain member 72 at one end.

The remainder of member 72 is threaded through opening 86 in section 68 and terminates in a pull 89.

As shown in FIG. 16, member 72 is manually pulled to cause sections 68, 70 to move towards one another, while sections 64 and 66 remain in a flat position. As a result of the movement of section 68, 70, the sides of the bag into which apparatus 13 is inserted are pushed outwardly to expand the bag in which the apparatus is inserted. The arrows in FIG. 16 show the inward and upward movement of sections 68, 70 of apparatus 13 as member 72 is pulled in the direction of the arrow. As section 70 slides over section 64, tab 82 of section 70 engages the first of the plurality of slots 90, 92, 94 of section 64. If member 72 is continued to be pulled, the tab 82 will move out of the first slot 90 and into the second one 92. Further pulling of member 72 will cause tab 82 to move out of the second slot and into the third slot 94. Insertion of tab 82 into any one of the slots 90, 92, 94 will secure section 70 and stabilize the apparatus 13. By providing a plurality of slots, the height of the gable may be varied, making the apparatus adjustable for bags having different sized gussets. Thus, if greater expansion is desired in the bag, tab 82 can be inserted into the slot 94; if lesser expansion is needed, slot 90 may be employed. Moreover, as with the expander 11, the locking means prevents retrograde movement upon application of compressive forces, and the structure can be collapsed by lifting the tab 82 out of any one of the slots and flattening the structure with compressive forces.

Member 62 of apparatus 13 may be formed from a single pieces of material or from two pieces of material. Thus, instead of having foldline 74, apparatus 13 could be formed by securing two separate pieces together by adhesive 88 or another fastening means to form a hinge.

As noted earlier, actuating member 72 is designed to extend through the mouth and outside of the bag containing apparatus 13. In this application, the bag need only be opened in a manner sufficient to allow member 72 to protrude from the bag. While a pull or handle 89 is provided to facilitate manual manipulation, it is not essential. Instructions for operating the apparatus 13 or other information may be imprinted on the pull 89.

Figure 18:
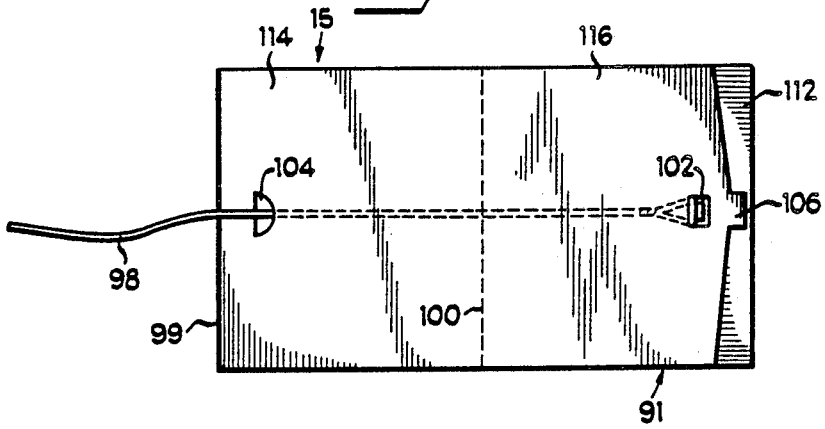
FIG. 18 is a plan view of the embodiment of FIG. 17 showing it in a flat folded position for insertion into a bag prior to expansion.
Figure 19:
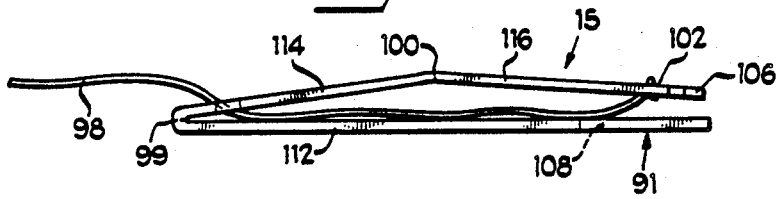
FIG. 19 is a side view of the embodiment of FIG. 17 showing it in a relatively flat, folded position similar to FIG. 18.

FIGS. 17–20 show a fourth embodiment 15 of the invention. Apparatus 15 is similar to apparatus 13, but does not have sections that are secured to each other by adhesive means. Apparatus 15 has a flat elongated member 91 comprising three sections 112, 114, 116 arranged in tandem and an actuator member 98. As in the other embodiments, member 91 may be constructed of corrugated board, cardboard or other suitable material. Member 98 may be a string, tape, plastic wire, or the like, and can be designed to extend outside of the soft bag containing apparatus 15. Sections 112, 114, 116 are formed by foldlines 99, 100 located on member 91. Sections 114 and 116 are adapted to fold about foldline 99 and over onto section 112, as shown in FIGS. 18 and 19. Actuator member 98 is secured to section 116 in slot 102 and extends through an opening 104 in section 114. A tab 106 is provided in section 116 for engaging slot 108 of section 112.

Figure 20:
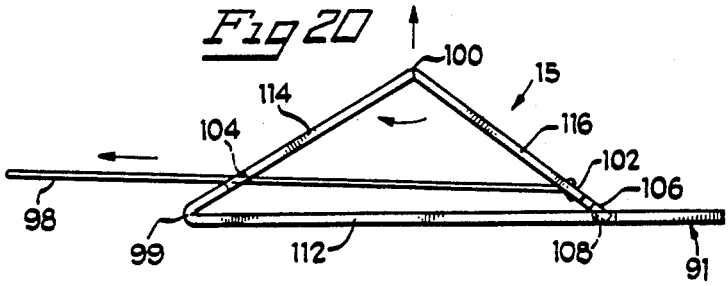
FIG. 20 is a side view of the embodiment of FIG. 17 showing movement of the parts and their relationship to one another when the apparatus is actuated into its position for expanding a bag.
Figure 21:
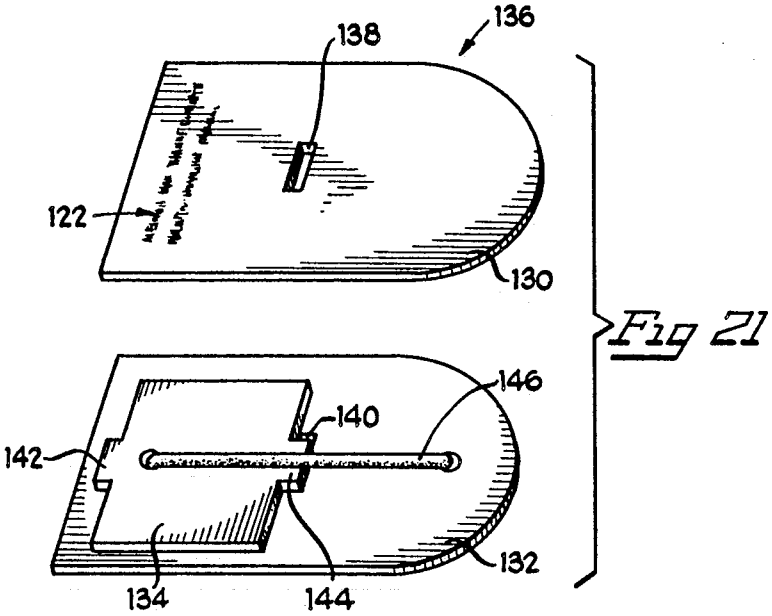
FIG. 21 is an exploded perspective view of a fifth embodiment of the invention, employing automatic expanding means.
Figure 23:
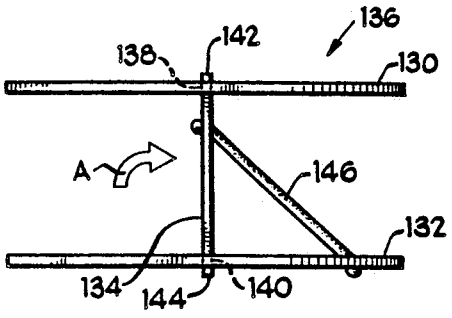
FIG. 23 is a side view of the embodiment of FIG. 21 showing the apparatus in a expanded and locked condition.

FIGS. 18 and 19 show apparatus 15 as it appears generally flat for insertion into a bag. As shown in FIG. 20, pulling actuator member 98 in the direction of the arrow causes section 116 to move over section 112 and towards section 114. This forms a gable that pushes the sides of a bag outwardly, and thereby expands the bag. Tab 106 of section 116 engages opening 108 of section 112 and is thereby securely retained, affording stability to apparatus 15. This structure may be collapsed by lifting tab 106 out of the opening 108 and applying a compressive force to the gable. If desired, several openings similar to opening 108 may be added to provide adjustability of the device.

Actuator member 98 can be designed to extend outside of the bag containing apparatus 15 in the same manner as is described for apparatus 13.

Figure 22:
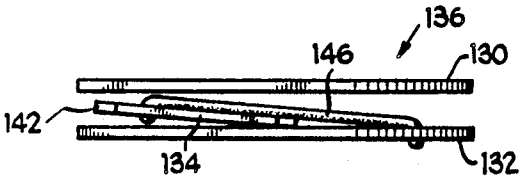
FIG. 22 is a side view of the embodiment of FIG. 21 in a flattened condition prior to insertion into a soft bag.
Figure 24:
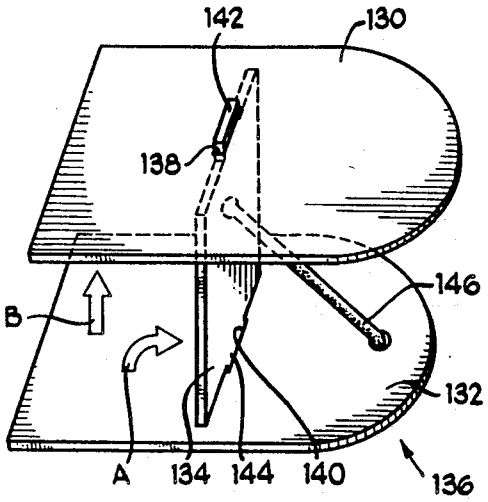
FIG. 24 is a perspective view of the embodiment of FIG. 21 showing the apparatus in an expanded and locked position.
Figure 25:
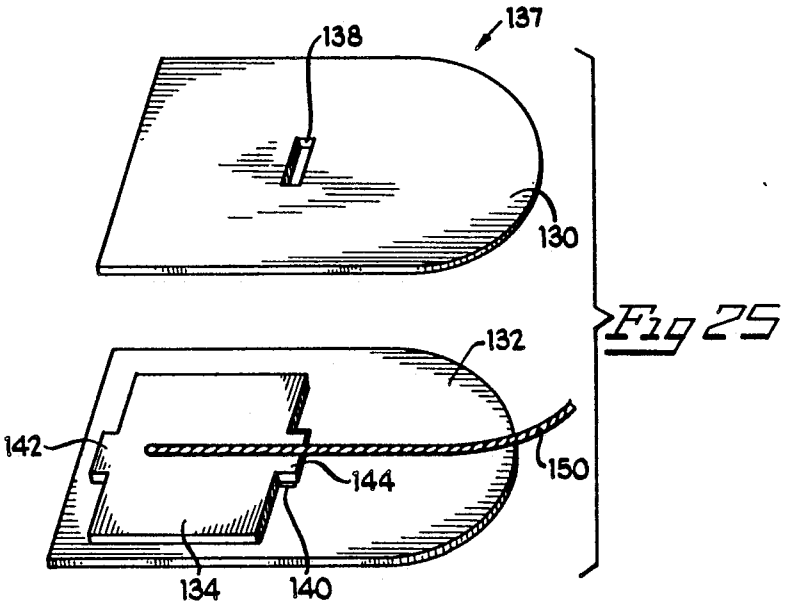
FIG. 25 is an exploded perspective view of a sixth embodiment of the invention, employing manual expanding means.
Figure 27:
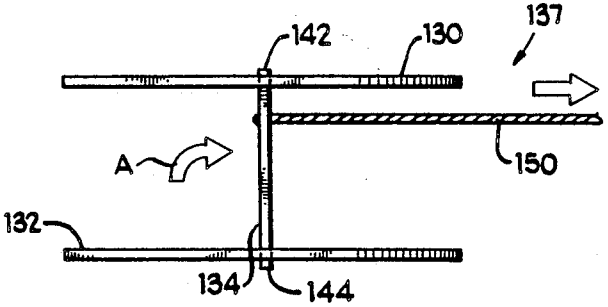
FIG. 27 is a side view of the embodiment of FIG. 25 showing the apparatus in an expanded and locked position.
Figure 26:
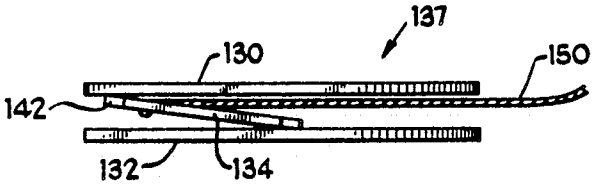
FIG. 26 is a side view of the embodiment of FIG. 25 in a flattened condition prior to insertion into a soft bag.
Figure 28:
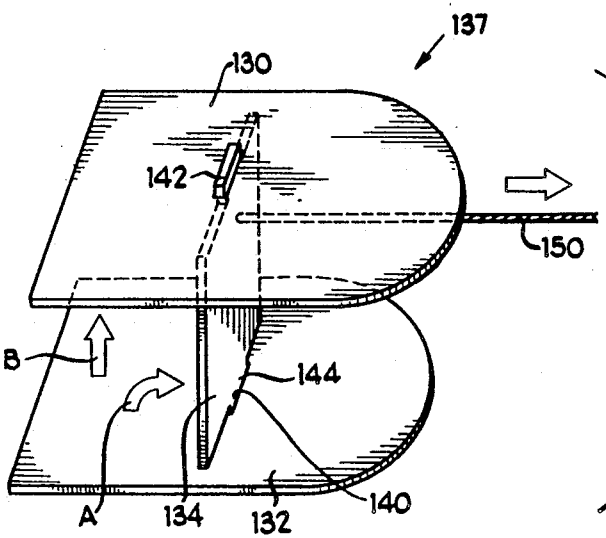
FIG. 28 is a perspective view of the embodiment of FIG. 25 showing the apparatus in an expanded and locked position.

Further embodiments 136 and 137 are shown in FIGS. 21–28, each of which includes three completely separate pieceparts 130, 132 and 134. The embodiment 136 of FIGS. 21–24 differs from the structure 137 of FIGS. 25–28 in that it employs a resilient member 146 and functions automatically, whereas the latter employs a cord or string 150 and functions manually. The outer panels 130, 132 contain keepers or slots 138, 140, respectively. The central or actuator panel 134 of each embodiment has a pair of oppositely disposed tabs 142, 144 thereon. As shown in FIGS. 21–25, e.g., resilient member 146 is secured to panels 132 and 134. Tab 144 normally fits into the keeper or slot 140 and is held there under the pull of the resilient member 146 while the structure 136 is in its collapsed state (FIG. 22). When the compressive forces are removed from the structure 136, the resilience of member 146 pulls the central or actuator panel 134 to an upright position in the direction shown by the arrow A in FIGS. 23 and 24. This pushes panel 130 away from panel 132, as shown by arrow B in FIG. 24. The tab 142 fits into keeper or slot 138 and holds the two outer panels 130, 132 in a locked, separated state.

In embodiment 137 of FIGS. 25–28, the parts 130–134 are the same as correspondingly numbered parts in FIGS. 21–24, and function in the same way. In this embodiment, a manual operating device 150, secured to panel 134, is provided to pull the panel 134 to an upright position in the direction shown by the arrow A in FIGS. 27 and 28. Device 150 is a cord, string or the like. Once panel 134 is in position, it holds the outer panels 130, 132 in a locked separated position, which expands a soft bag. The relative movement of the panels 130 and 132 caused by the movement of the actuator panel 134 is shown by arrow B in FIG. 28.

If it is desired to collapse the structure of either embodiment 136 or 137 from an upright position, the tab 142 may be disengaged from slot 138 and the parts 130, 132 and 134 collapsed to their flattened state.

The panels 130, 132 are shaped to fit into a soft bag having the contours of a satchel, such as an athletic bag, for example. Thus, the term "outer panel" or the like should be construed as "having any suitable" shape. One might well imagine a clam shell shape and other unique shapes, which may be accommodated in a similar manner.

Because the inventive apparatus is made from flat paperboard stock or similar material, it may carry printed information 122, such as advertising, bag care instructions, or decorative indicia. In this way, the bag expanding means of this invention can be used to deliver messages to the ultimate purchasers of the bags.

FIGS. 29–44 show further embodiments of the present invention in which the expandable piece of the expanding device has at least four sections with each section foldably attached to each of two adjacent sections such that the expandable piece can be articulated from an initial position in which two adjacent sections forming a first set of sections are in a substantially flat coplanar position and overlap the other two sections forming a second set of sections which are also in a substantially flat coplanar position through a series of intermediate diamond or rhomboid positions to a fully expanded position in which the sections of the first set are in a substantially parallel relation to each other and the sections of the second set are in a substantially parallel relation to each other. It will be appreciated from the drawings and the descriptions of these embodiments that the expandable piece of these embodiments in effect form a pair of gables that are inverted with respect to each other. Accordingly, this expandable device permits, for any given angular relation between two sections forming a set of sections, expansion to an extent, in a direction substantially transverse to the substantially flat planes in which the sections forming each set are in when the expandable piece is in the initial position, that is generally twice as great as the extent of expansion obtainable from an expandable piece of the embodiments shown in FIGS. 1–20 for the same length of the expandable piece when it is in the initial position.

Figure 29:
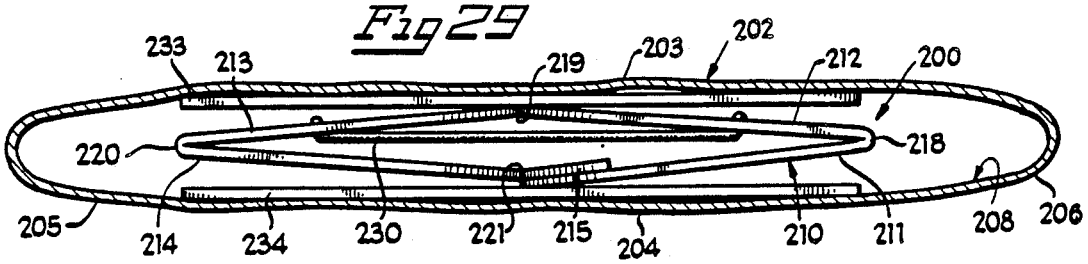
FIG. 29 is a sectional view of a seventh embodiment of the invention in a collapsed, substantially flattened state.
Figure 31:
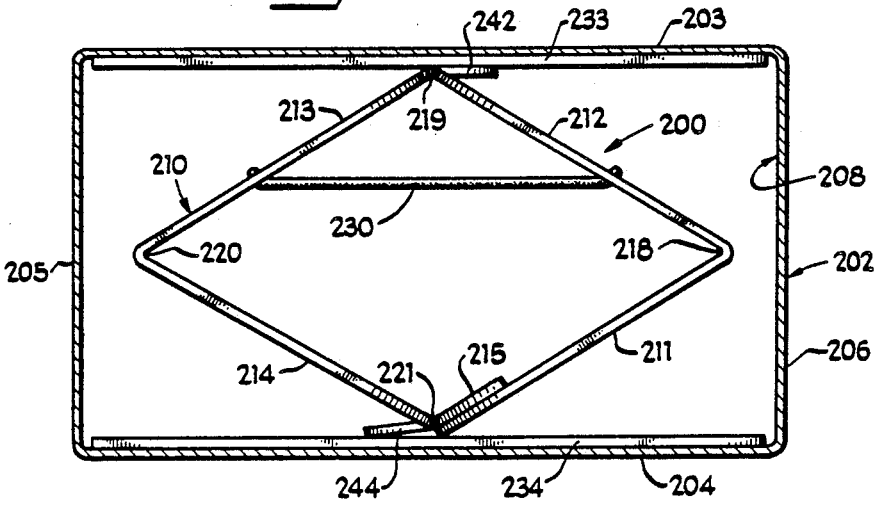
FIG. 31 is a sectional view of the same combination as is shown in FIG. 29 except that the expanding device has been urged to an expanded position until restrained by the predetermined shape of the expanded bag compartment.

In FIG. 29 a bag expanding device 200 is shown in combination with a soft bag 202 such as that illustrated in FIG. 3. Soft bag 202 has a pair of opposed side portions 203 and 204 with end panels 205 and 206 connecting side portions 203 and 204, and together with the side portions defining a compartment 208 that is expandable to the predetermined shape illustrated in FIG. 31. Side portions 203 and 204, as well as end panels 205 and 206, are made of a soft flexible or supple material such as nylon, vinyl, denim or the like so that bag 202, together with inserted expanding device 200, may be readily collapsed into a substantially flattened state somewhat like that illustrated in FIG. 29 or expanded into a substantially stuffed state as illustrated in FIG. 31. In the substantially stuffed state, side portions 203 and 204 are spaced apart from each other to substantially the full extent permitted by end panels 205 and 206 so that the defined predetermined shape of expanded compartment 208 restrains expanding device 200.

Figure 30:
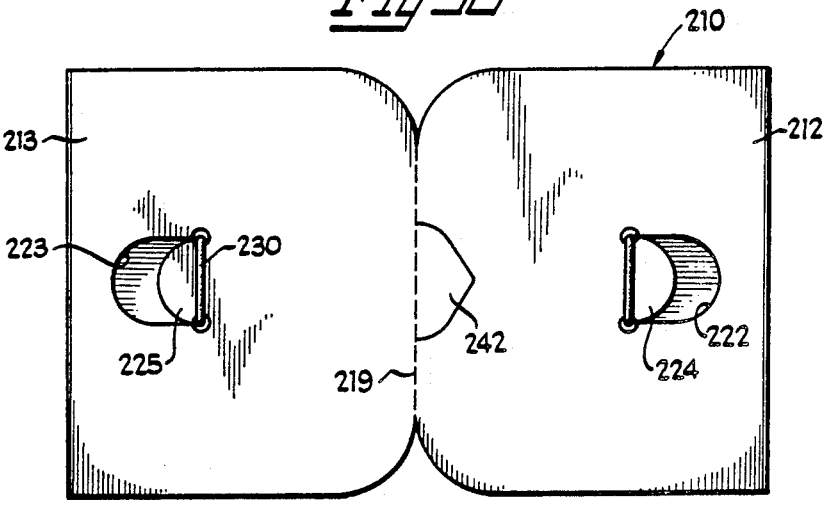
FIG. 30 is a top plan view showing the expanding device in an initial, substantially flat overlapping coplanar position prior to insertion into the soft bag.

Included in expanding device 200 is an expandable piece 210 which is shown in top plan view in FIG. 30. Expandable piece 210 is formed of a single piece of material into four sequentially arranged sections 211, 212, 213 and 214 plus an end flap 215. Adjacent sections 211 and 212 are separated by a foldline 218, adjacent sections 212 and 213 are separated by a foldline 219, adjacent sections 213 and 214 are separated by a foldline 220 while section 214 and adjacent flap 215 are separated by a foldline 221. As is best illustrated in FIGS. 29 and 31, the outer surface of flap 215 overlaps part of the inside surface of section 211. Flap 215 and the portion of section 211 that overlaps are secured together by a suitable adhesive to form a continuous multi-section structure. With flap 215 adhesively secured to section 211, sections 211 and 214 effectively become adjacent sections that are articulatable about foldline 221. Expandable piece 210 may be constructed of corrugated board, cardboard, plastic or any other suitable material. Of course, if a plastic is used it would have to be one having properties similar to polypropelene which permits the use of a living hinge for the foldlines.

It will be appreciated, particularly from FIG. 29 that expandable piece 210 is articulatable from an initial collapsed position in which adjacent sections 212 and 213, which form a first set of sections, are in a substantially flat coplanar position and overlap adjacent sections 211 and 214 which form a second set of sections and are also in a substantially flat coplanar position to a fully expanded position in which adjacent sections 212 and 213 of the first set are in a substantially parallel relation to each other and adjacent sections 211 and 214 of the second set are also in a substantially parallel relation to each other. Pulling or pushing the adjacent sections forming either set, such as sections 212 and 213, toward each other will articulate expandable piece 210 between the initial collapsed position in which its elongated direction is a generally horizontal one as viewed in FIG. 29 to a generally vertical one in the fully expanded position. During the course of such articulation from the substantially flat horizontal position to the substantially vertical position, expandable piece 210 can assume an almost infinite number of intermediate positions in which it is in the shape of a diamond or rhomboid such as the one illustrated in FIG. 31.

Each of sections 212 and 213 have a respective cutout 222 and 223 leaving a respective ear 224 and 225. Attached about each of ears 224 and 225 is a resilient member 230 in the form of an elastic loop which is under tension when expandable piece 210 is in the position illustrated in FIG. 29. Accordingly, in the absence of a compressive force on expandable piece 210 that overcomes the force of resilient member 230, the resilient member urges the expandable piece out of the initial collapsed position that is approximately illustrated in FIG. 29 toward the fully expanded position until articulation of expandable piece 210 is restrained in an intermediate position by the predetermined shape of expanded compartment 208 with each of adjacent sections 212 and 213 at an angle to each other and adjacent sections 211 and 214 at essentially the same angle to each other as illustrated in FIG. 31. In this intermediate position resilient member 230 is still in tension.

To assist in uniform expansion of soft bag 202 and for a smooth appearance of the bag in the substantially stuffed state, generally rigid inserts 233 and 234 are provided. The generally rigid inserts may, like expandable piece 210, be constructed of corrugated board, cardboard, plastic or any other suitable material. One of each of the generally rigid inserts is inserted inside compartment 208 adjacent to a respective one of the side portions and spaced from the other generally rigid insert with the expandable piece between them. Thus, generally rigid insert 233 is inserted adjacent to side portion 203 while generally rigid insert 234 is inserted adjacent to side portion 204 and expandable piece 210 is sandwiched between inserts 233 and 234. The outline of each of the generally rigid inserts substantially conforms to the outline of the portion to which it is adjacent. Thus, in the case of a back-pack as is shown in FIG. 10 or another soft bag as is shown in FIG. 3 having a generally rectangular solid appearance in the substantially stuffed state, each of the generally rigid inserts would be generally planar and have a rectangular shape or outline conforming to the portion to which it is adjacent.

Sections 212 and 214, as is best illustrated in FIGS. 30 and 31, are each formed with a respective die-cut, punch-out tabs 242 and 244 (tabs 242 and 244 have been omitted from FIG. 29 for ease of illustration). Tab 242 articulates about foldline 219 while tab 244 articulates about foldline 221. With die-cut tabs 242 and 244 punched or pushed out of the plane of their respective sections to the general positions illustrated in FIG. 31, each of tabs 242 and 244 engage a generally rigid insert 233 and 234, respectively. Hence, the tabs provide greater frictional engagement between expandable piece 210 and generally rigid inserts 233 and 234 to help maintain expandable piece 210 in a particular relation to the outline of the generally rigid inserts.

Prior to shipment by the manufacture to a customer, expanding device 200 is inserted into soft bag 202 in a collapsed, substantially flattened state similar to that illustrated in FIG. 29 although in actual use it would be even more collapsed and flattened, in FIG. 29 expanding device 200 has been illustrated in a slightly expanded state for ease of illustration. A number of soft bags 202 with expanding inserts 200 are placed in a sealed container or master carton in the collapsed, substantially flattened state to maximize shipping space. The compressive forces resulting from such packing maintains the soft bags and expanding inserts in the collapsed, substantially flattened state. However, when a soft bag 202 is removed from the master carton, resilient member 230 will urge sections 212 and 213 toward each other, and will simultaneously urge sections 211 and 214 toward each other, until restrained by the predetermined shape of the expanded compartment 208 defined by soft flexible material side portions 203 and 204 plus end panels 205 and 206.

Figure 33:
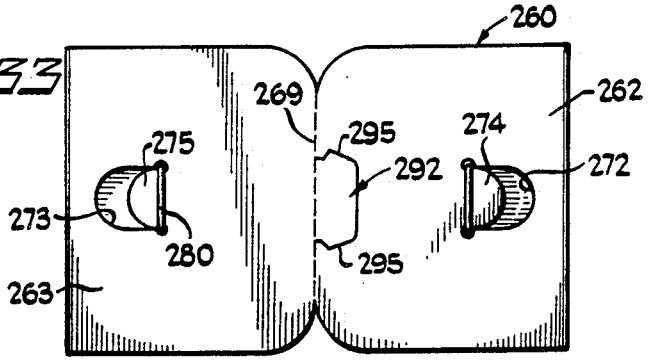
FIG. 33 is a top plan view of the expanding device in an initial, substantially flat overlapping coplanar position prior to insertion into the soft bag.
Figure 34:
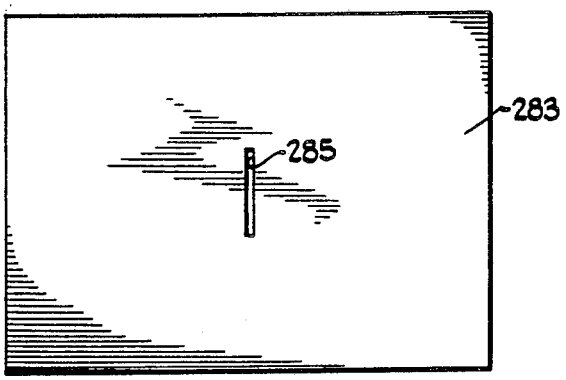
FIG. 34 is a top plan view of a generally rigid insert for use in combination with the expandable device shown in FIG. 33.
Figure 32:
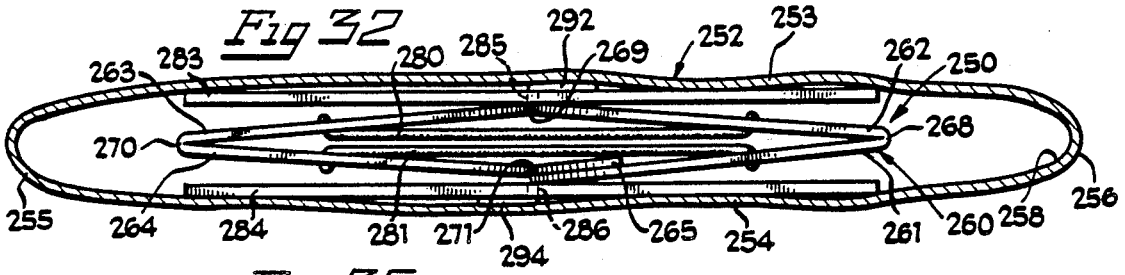
FIG. 32 is a sectional view of an eighth embodiment of the invention in a collapsed, substantially flattened state.
Figure 35:
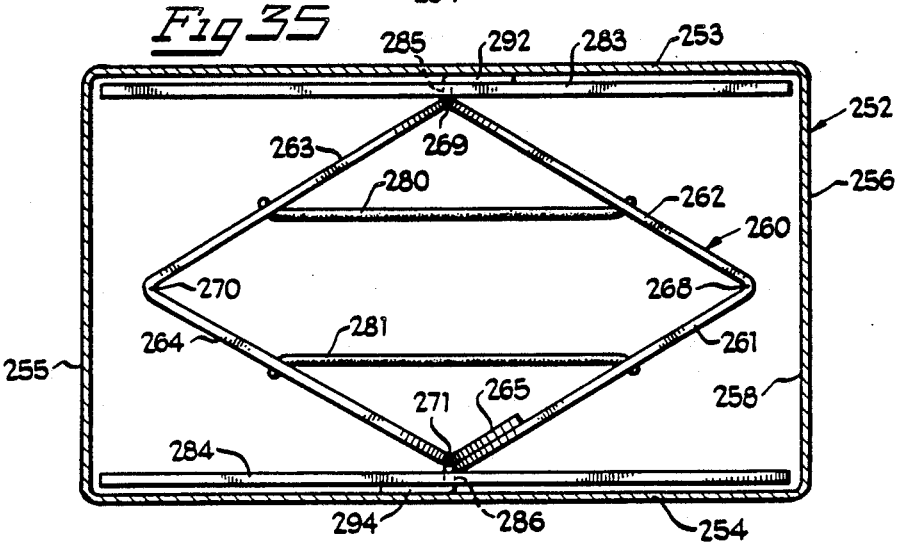
FIG. 35 is a sectional view of the same combination shown in FIG. 32 but with the expanding device urged to an expanded position and restrained by the predetermined shape of the expanded bag compartment.

FIGS. 32–35 show another embodiment of the present invention that has additional features not present in the embodiment shown in FIGS. 29–31. In FIG. 32, a bag expanding device 250 is shown in combination with a soft bag 252 that has a pair of opposed side portions 253 and 254. A pair of end panels 255 and 256 connect the side portions and, together with the side portions, define a compartment 258 that is expandable to the predetermined shape illustrated in FIG. 35. A soft flexible material is used for side portions 253 and 254 as well as for end panels 255 and 256 so that bag 252, together with inserted expanding device 250, may be readily collapsed into a substantially flattened state approximately like that illustrated in FIG. 32 or expanded into a substantially stuffed state as illustrated in FIG. 35. In actual use, both expanding device 250 and soft bag 252 may be collapsed into a flatter state that is illustrated in FIG. 32 in which expanding device 250 is shown in a slightly expanded state for ease of illustration of its various components. In the substantially stuffed state, side portions 253 and 254 are spaced apart from each other to substantially the full extent permitted by end panels 255 and 256 so that the defined predetermined shape of expanded compartment 258 restrains expanding device 250.

Included in expanding device 250 is an expanding piece 260 which is shown in top plan view in FIG. 33. Expandable piece 260 is formed of a single piece of material, such as corrugated board, cardboard, a plastic or any other suitable material, into four sequentially arranged sections 261, 262, 263 and 264 plus an end flap 265. Adjacent sections 261 and 262 are separated by a foldline 268, adjacent sections 262 and 263 are separated by a foldline 269, adjacent sections 263 and 264 are separated by a foldline 270 while section 264 and adjacent flap 265 are separated by a foldline 271. Flap 265 and the portion of section 261 that it overlaps are secured together by a suitable adhesive resulting in sections 261 and 264 effectively becoming adjacent sections that are articulatable about foldline 271. Accordingly, expandable piece 250 forms a continuous multisection structure that may be articulated from an initial collapsed position in which one set of adjacent sections are in a substantially flat coplanar position and overlap another set of adjacent sections that are also in a substantially flat coplanar position to a fully expanded position in which adjacent sections 262 and 263 of the first set are in a substantially parallel relation to each other and adjacent sections 261 and 264 of the second set are also in a substantially parallel relation to each other.

Pulling or pushing adjacent sections forming a set toward each other will articulate expandable piece 260 between the initial collapsed position in which its elongated direction is a generally horizontal one as viewed in FIG. 32 to a generally vertical one in the fully expanded position. During the course of such articulation from the substantially flat horizontal position to the substantially vertical position, expandable piece 260 can assume an almost infinite number of intermediate positions in which it is in the shape of a diamond or rhomboid, such as the one illustrated in FIG. 35.

Each of sections 262 and 263 have a respective cutout portion 272 and 273 leaving a respective ear 274 and 275. Attached about each of ears 274 and 275 is a resilient member 280 in the form of an elastic loop which is under tension when expandable piece 260 is in the position illustrated in FIG. 32. Similarly, each of sections 261 and 264 have respective cut-outs and ears (not shown) about which a second resilient member 281 is attached. Like resilient member 280, the second resilient member 281 is also in the form of an elastic loop which is under tension when expandable piece 260 is in the initial collapsed position. Accordingly, both resilient members 280 and 281, by exerting force on the respective sections to which they are attached, urge expandable piece 260 out of the initial collapsed position toward the fully expanded position until articulation of expandable piece 260 is restrained in an intermediate position by the predetermined shape of expanded compartment 258. When expandable piece 260 is restrained by the predetermined shape of expanded compartment 258, as is illustrated in FIG. 35, each of adjacent sections 262 and 263 are at an angle to each other and adjacent sections 261 and 264 are essentially at the same angle to each other. In this intermediate position both resilient members 280 and 281 are still in tension.

For more uniform expansion of soft bag 252 and to provide for a smooth appearance of the expanded bag, generally rigid inserts 283 and 284 are provided. The generally rigid inserts may be constructed of the same material as expandable piece 260. Preferably, each of the generally rigid inserts has an outline that substantially conforms to the outline of the side portion that it will be adjacent to when it is inserted into compartment 258. As illustrated in FIG. 34, generally rigid insert 283 has a generally rectangular outline that would conform to a portion of a generally rectangular solid bag such as is illustrated in FIG. 3 or a back-pack such as is illustrated in FIG. 10. Generally rigid insert 283 is inserted into compartment 258 of soft bag 252 adjacent to side portion 253 while generally rigid insert 284 is inserted adjacent to side portion 254 with the generally rigid inserts spaced from each other by expandable piece 260. Insert 283 is provided with a generally centrally disposed slot 285 and generally rigid insert 284 is provided with a similar slot 286.

Each of sections 262 and 264 are formed with a respective die-cut, push-out tab 292 and 294. As is best illustrated in FIG. 33, each of the tabs has outwardly extending barbed sides 295. When pushed out of the plane of their respective section, each of the tabs articulate about a foldline. Thus, tab 292 articulates about foldline 269 while tab 294 articulates about foldline 271. Each tab engages a respective slot of a generally rigid insert to maintain expandable piece 260 in a particular side-to-side and end-to-end relation between the expandable piece and the generally rigid insert. Barbed ends 295 help keep the tab from pulling out of the slot once it is inserted into the slot. The engagement of tabs 292 and 294 with their respective slots 285 and 286 facilitate putting the expandable piece together with the generally rigid inserts as a subassembly prior to insertion into the compartment of the soft bag.

As with the other embodiments, soft bag 252 with expanding device 250 inserted into compartment 258 is maintained in the collapsed, substantially flattened state during shipment by the compressive forces resulting from packaging of a number similarly collapsed, substantially flattened soft bags with inserted expanding devices within a sealed master carton. Upon opening of the sealed container and removal of the collapsed, substantially flattened soft bags, resilient members 280 and 281 will urge expandable piece 260 from its initial collapsed position. Expandable piece 260 will in turn push the generally rigid inserts further apart against their respective side portions until the expansion of the expanding device is restrained by the predetermined shape of the expanded compartment with the expandable piece in an intermediate position in the shape of a diamond or a rhomboid.

FIGS. 36–44 illustrate further embodiments of the invention which are somewhat similar to those in FIGS. 29–35 but with some further changes and modifications for adaptation of the expanding device for use in combination with a generally cylindrical soft bag of the type sometimes referred to as a barrel bag. An expanding device 300 is contained within a soft barrel bag 302 which is shown in its expanded, substantially stuffed state in FIG. 36 and in a collapsed, substantially flattened state in FIG. 37.

Figure 36:
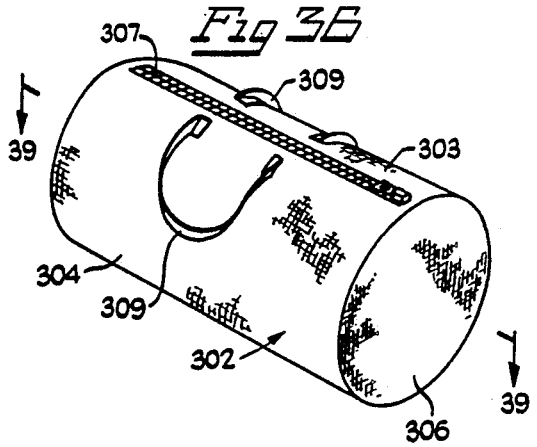
FIG. 36 is perspective view of a ninth embodiment of the invention showing a soft bag expanded into a substantially stuffed state in which it has a generally cylindrical predetermined shape.
Figure 37:
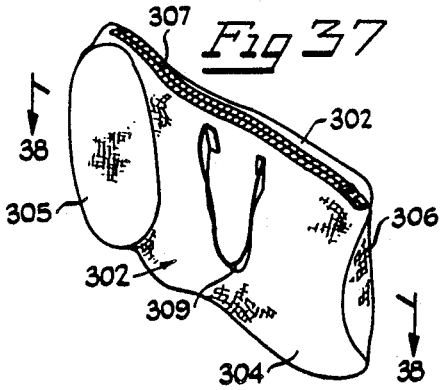
FIG. 37 is a perspective view of the embodiment shown in FIG. 36 with the soft bag collapsed into a substantially flattened state.
Figure 38:
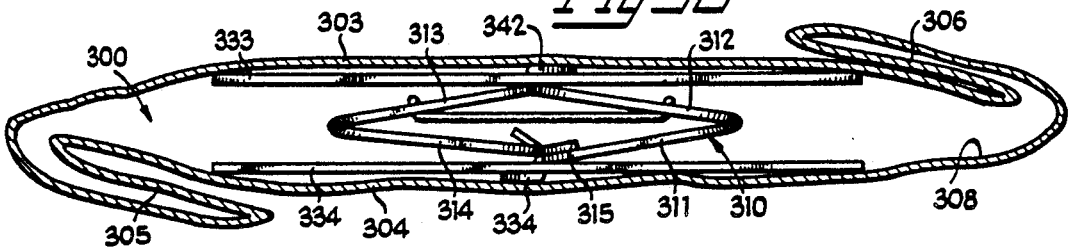
FIG. 38 is a sectional view taken generally along line 38—38 of FIG. 37.
Figure 39:
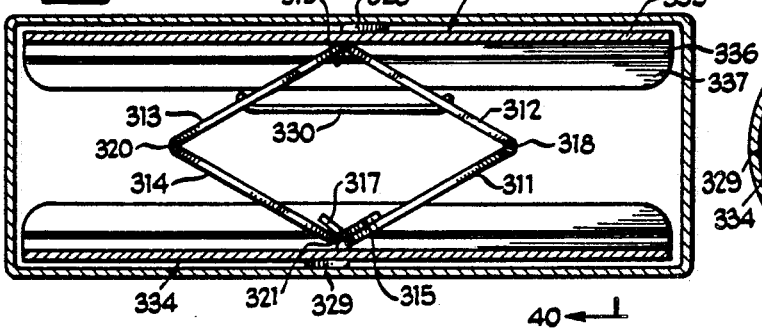
FIG. 39 is a sectional view taken substantially along line 39—39 of FIG. 36.
Figure 40:
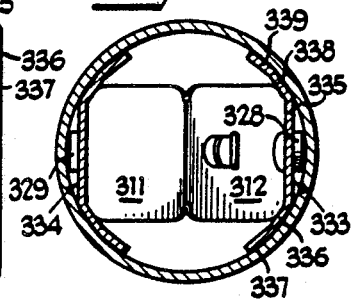
FIG. 40 is a sectional view taken generally along line 40—40 of FIG. 39.

Barrel bag 302 has opposed side portions 303 and 304 which may be constructed of a single piece of soft flexible material to also form the bottom of the barrel bag. A pair of end panels 305 and 306 connect side portions 303 and 304 which may be secured together along their respective top edges by a zipper 307. End panels 305 and 306, together with side portions 303 and 304 define a compartment 308 that is expandable to a predetermined generally cylindrical shape as is best illustrated in FIGS. 36, 39 and 40. To facilitate carrying of barrel bag 302, a handle 309 is attached to each side portion. The same soft flexible material may be used to construct end panels 305 and 306 as is used for the piece or pieces forming side portions 303 and 304. However, a more rigid material may be used for the end panels with soft bag 302 still being collapsible into a substantially flattened state when folded as illustrated in FIGS. 37 and 38. In the substantially stuffed state, side portions 303 and 304 are spaced apart from each other to the full extent permitted by end panels 305 and 306 so that the defined predetermined shape of expanded compartment 308 restrains expanding device 300.

Figure 41:
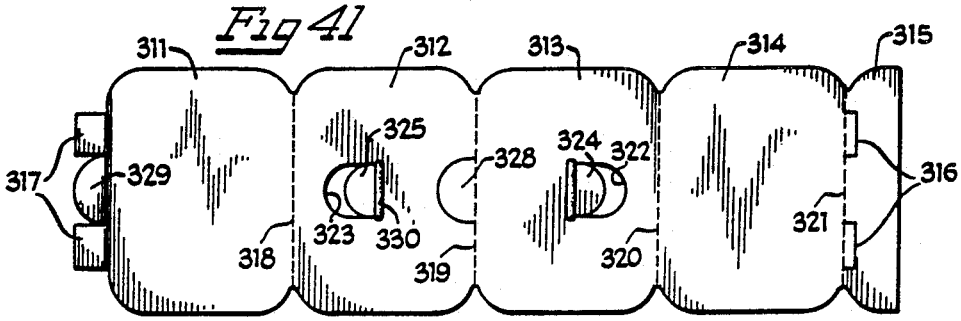
FIG. 41 is a top plan view of an expandable piece as an unfolded, unarticulated blank.

Included in expandable device 300 is an expandable piece 310 which is shown in FIG. 41 in top plan view as an unfolded, unarticulated blank and in FIG. 42, again in top plan view, after it has been folded and articulated into the initial collapsed position. Expandable piece 310 is formed of a single piece of corrugated board, cardboard, plastic or any other suitable material into four sequentially arranged sections 311, 312, 313, and 314 plus an end flap 315. Adjacent sections 311 and 312 are separated by a foldline 318, adjacent sections 312 and 313 are separated by a foldline 319, adjacent sections 313 and 314 are separated by a foldline 320 while sections 314 and adjacent flap 315 are separated by a foldline 321. A pair of spaced apart slots 316 extend through end flap 315 along a line generally parallel to foldline 321. Extending outwardly from the free edge of section 311 that is parallel to foldline 318 are a pair of spaced apart tabs 317 that are aligned with slots 316. As is best shown in FIGS. 38 and 39, when expandable piece 310 is folded into a continuous multi-section structure, end flap 315 will overlap part of section 311 and each one of tabs 317 will fit into and through a respective slot 316 to secure expandable piece 310 in the continuous multi-section structure. Thus, the need for an adhesive as used in the embodiments of FIGS. 29–34 is obviated.

It will be appreciated, that as with the embodiments of FIGS. 29–34, expandable piece 310 is articulatable from an initial collapsed position in which adjacent sections 312 and 313, which form a first set of sections, are in a substantially flat coplanar position and overlap adjacent sections 311 and 314 which form a second set of sections and are also in a substantially flat coplanar position to a fully expanded position in which adjacent sections 312 and 313 of the first set are in a substantially parallel relation to each other and adjacent sections 311 and 314 of the second set are also in a substantially relation to each other. Pulling or pushing the adjacent sections forming either set, such as sections 312 and 313, toward each other will articulate expandable piece 310 between the initial collapsed position in which its elongated direction is generally parallel to or coincident with the axis of the predetermined cylindrical shape of expanded compartment 308, and is generally horizontal as viewed in FIG. 38, to a generally vertical one in the fully expanded position. During the course of such articulation from the substantially flat horizontal position to the substantially vertical position, expandable piece 310 can assume an almost infinite number of intermediate positions in which it is in the shape of a diamond or rhomboid such as the one illustrated in FIG. 39.

Each of sections 311 and 313 have a respective cutout 322 and 323 leaving a respective ear 324 and 325. In addition, section 312 has a die-cut, push-out tab 328 while section 311 has a similar die-cut, push-out tab 329. Attached about each of ears 324 and 325 is a resilient member 330 in the form of an elastic loop which is under tension when expandable piece 310 is in the initial collapsed position. Accordingly, in the absence of a compressive force which overcomes the force of resilient member 330, the resilient member urges expandable piece 310 out of the initial collapsed position that is approximately illustrated in FIG. 38 toward the fully expanded position until the articulation of expandable piece 310 is restrained in an intermediated position by the predetermined cylindrical shape of expandable compartment 308. With expandable piece 310 restrained by the predetermined shape of expanded compartment 308, each of adjacent sections 312 and 313 are at an angle to each other and adjacent sections 311 and 314 are at essentially the same angle to each other as is illustrated in FIG. 39.

Figure 43:
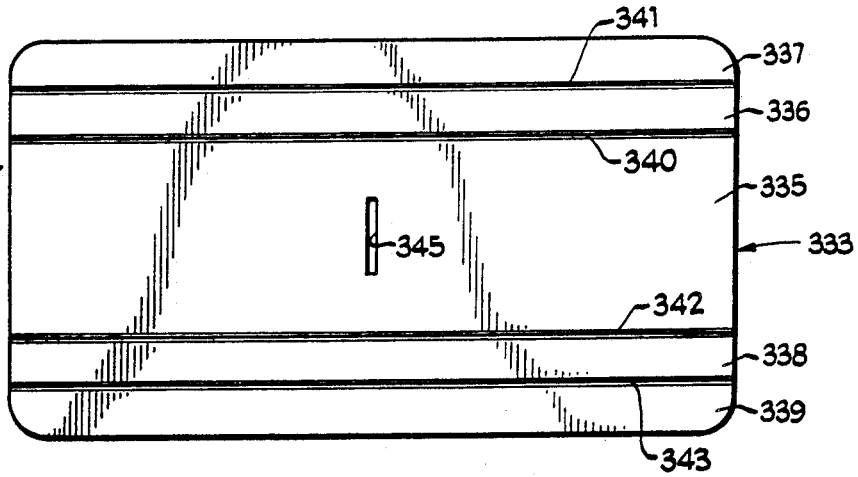
FIG. 43 is a top plan view of the generally rigid insert illustrated in FIGS. 38, 39 and 40 in a substantially planar position as an unarticulated blank.
Figure 42:
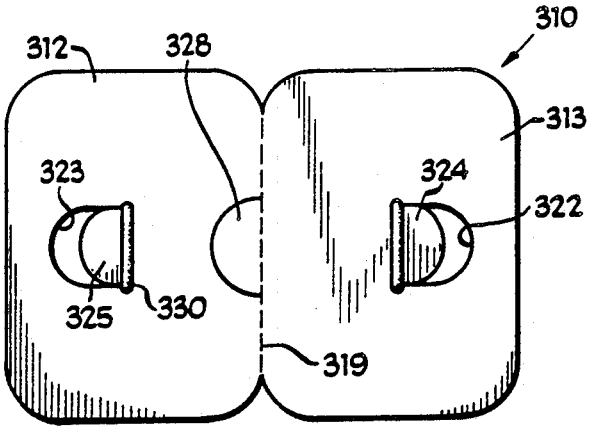
FIG. 42 is a top plan view of the expandable piece illustrated in FIG. 41 after it has been folded and articulated into the initial collapsed position in which two two adjacent sections that form a first set are in a substantially flat coplanar position and overlap the two sections forming a second set which are also in a substantially flat coplanar position.

For more uniform expansion of soft bag 302 and a smoother appearance of the bag in the expanded, substantially stuffed state, generally rigid inserts 333 and 334 are provided. The generally rigid inserts may, like expandable piece 310, be constructed of corrugated board, cardboard, plastic or any other suitable material that is capable of being formed into an articulatable structure. As is best illustrated in FIGS. 39, 40 and 43, each of generally rigid inserts 333 and 334 are formed with a central generally elongated rectangular segment 335. Along one elongated side edge of central segment 335 is a narrower segment 336 which in turn has another segment 337 adjacent its elongated outer edge. Similarly, along the other elongated edge of central segment 335 is a narrower segment 338 having another segment 339 along its outer elongated edge. Segment 335 is separated from segment 336 by a foldline 340 while segment 336 is separated from segment 337 by a foldline 341. On the other side, segment 335 is separated from segment 338 by a foldline 342 while segment 338 is separated from segment 339 by a foldline 343. Thus, it will be appreciated, particularly from FIGS. 39 and 40, that generally rigid insert 333, as well as generally rigid insert 334 which is similarly constructed, may be articulated from the generally planer position illustrated in FIG. 43 to an arcuate condition in which the insert substantially conforms to a side portion of the predetermined cylindrical shape of expanded compartment 308.

Generally centrally disposed in segment 335 is a slot 345 that extends through the generally rigid insert. A similar slot is provided in generally rigid insert 334. One of each of tabs 328 and 329 fits through the slot of a respective one of generally rigid inserts of 333 and 334 to maintain expandable piece 310 in a particular relation with each of the generally rigid inserts. The use of the tab and slot engagement not only helps prevent shifting of the expandable piece with respect to the generally rigid inserts during expansion of the expanding device in combination with the soft bag but also facilitates insertion of the expanding device as a subassembly into the soft bag prior to shipment.

Figure 44:
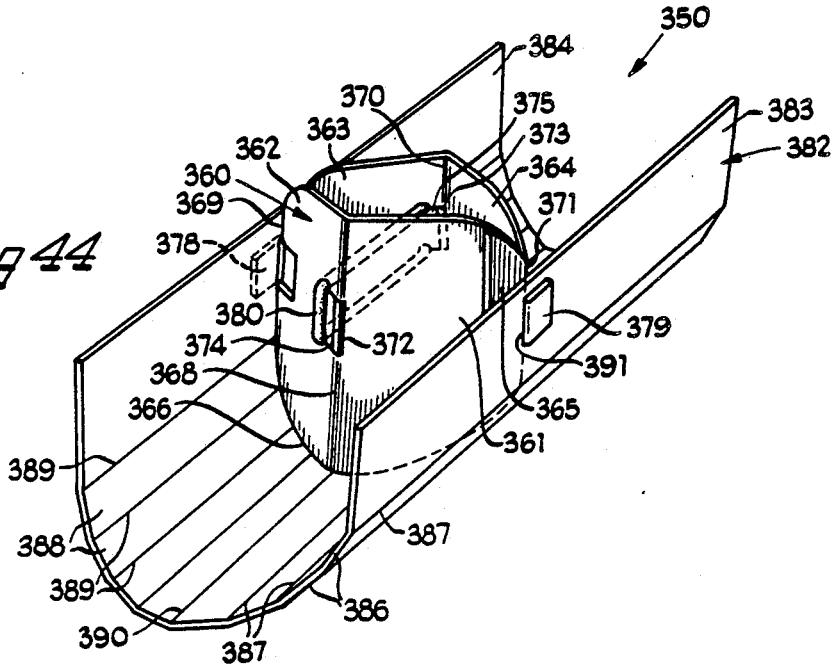
FIG. 44 is a perspective view of a tenth embodiment of the invention showing an expanding device outside of the soft bag with the expandable piece in an intermediate position.

FIG. 44 shows another embodiment of an expanding device 350 particularly adapted for use with a generally cylindrical or barrel bag such as soft bag 302 shown in FIGS. 36–40. Expanding device 350 includes an expandable piece 360 formed of a single piece of material into four sequentially arranged sections 361, 362, 363, and 364 plus an end flap 365. Sections 361 and 362 cooperate to form a generally semi-circular bottom edge 366 when expandable piece 360 is in the intermediate position shown in FIG. 44. Sections 363 and 364 also cooperate to form a similar semi-circular bottom edge (not shown). Adjacent sections 361 and 362 are separated by a foldline 368, adjacent sections 362 and 363 are separated by a foldline 369, adjacent sections 363 and 364 are separated by a foldline 370 while section 364 and adjacent flap 365 are separated by a foldline 371. End flap 365 overlaps and is secured to a portion of section 361 by a suitable adhesive resulting in sections 361 and 364 effectively becoming adjacent sections that are articulatable with respect to each other about foldline 371. Accordingly, expandable piece 360 is articulatable from an initial collapsed position in which adjacent sections 362 and 363, which form a first set of sections, are in a substantially flat coplanar position and overlap adjacent sections 361 and 364 which form a second set of sections and are also in a substantially flat coplanar position to a fully expanded position in which adjacent sections 362 and 363 of the first set are in a substantially parallel relation to each other and adjacent sections 361 and 364 of the second set are also in a substantially parallel relation to each other.

Each of sections 362 and 363 have a respective cutout 372 and 373 leaving a respective ear 374 and 375. Section 362 has a die-cut, push-out tab 378 that is articulatable about foldline 369 and section 364 has a die-cut, push-out tab 379 that is articulatable about foldline 371. A resilient member 380 in the form of an elastic loop which is under tension when expandable piece 360 is in the initial collapsed position is attached about each of ears 374 and 375.

To assist the uniform expansion of a soft cylindrical or barrel bag and for a smoother appearance of the bag in a substantially stuffed state a generally rigid insert 382 is provided. Generally rigid insert 382 is constructed from a single piece of corrugated board, cardboard, plastic, or other suitable articulatable material and has a pair of opposed generally elongated rectangular segments 383 and 384 connected to each other by a series of sequentially arranged intermediate segments. Extending toward segment 384 from segment 383 are a sequential series of four, somewhat narrower segments 386. The one segment 386 adjacent segment 383 is separated from segment 383 by a foldline 387 and each of segments 386 are also separated from each other by similar foldlines 387. Segment 384 has a sequential series of four somewhat more narrow segments 388 extending from its inboard elongated edge toward segment 383. The one segment 388 adjacent segment 384 is separated from segment 384 by a foldline 389 and each of segments 388 are also separated from each other by similar foldlines 389. A central foldline 390 separates the adjacent ones of segments 386 and 388.

Segments 386 and 388 can be articulated into a generally semi-circular shape generally conforming to and abutting bottom edge 366 as well as the bottom edge formed by sections 363 and 364 of expandable piece 360. In the initial collapsed position of expanding device 350, generally rigid insert 382 is articulated about central foldline 390 such that segments 383 plus segments 386 lie substantially in one plane and overlap segments 384 plus segments 388 which lie in substantially another plane. Thus as is illustrated in FIG. 44, generally rigid insert 382 is articulatable, as a result of the expansion of expandable piece 360, into a generally semi-circular or U-shaped configuration which generally conforms to the desired rounded appearance of the predetermined cylindrical shape of the expanded compartment of the soft barrel bag.

Segment 383 has a slot 391 through which tab 379 is inserted and segment 384 has a similar slot (not shown) through which tab 378 is inserted to help maintain the relation between expandable piece 360 and generally rigid insert 382.

Expandable pieces 210, 260, 310 and 360 have all been shown and described as having four sides, however, it will be appreciated by those skilled in the art that more than four sides could be used such that the expandable piece would be in the shape of a pentagon, hexagon, octagon or the like in the intermediate position.

While specific embodiments have been described, all modifications and equivalents of such embodiments which fall within the principles of the invention are intended to be covered by the appended claims which should be construed to cover all such equivalents falling within the spirit and scope of the invention.

What is claimed as new and desired to be secured by Letters Patent is:

1. A bag expanding device in combination with a soft bag comprising:

a pair of opposed portions partially forming the bag;

means connecting the portions and, together with the portions, defining a compartment expandable to a predetermined shape;

one or more of the means and the portions being soft and flexible so that the compartment may be readily collapsed into a substantially flattened state or expanded into a substantially stuffed state in which the portions are spaced apart from each other to substantially the full extent permitted by the predetermined shape of the expanded compartment;

the expanding device including an expandable piece having at least four sections;

each of the sections of the expandable piece being foldably attached to each of two adjacent ones of the sections for articulation relative to each other;

two or more adjacent ones of the sections forming a first set of sections;

two or more adjacent ones of the sections, not forming the first set of sections, forming a second set of sections;

the expandable piece being articulatable between an initial collapsed position in which the two or more adjacent ones of the sections forming the first set of sections are in a substantially flat coplanar position and at least partially overlap the two or more adjacent ones of the sections forming the second set of sections which are also in a substantially flat coplanar position and a fully expanded position in which sections of the first set are in a substantially parallel relation to each other and sections of the second set are in a substantially parallel relation to each other;

the expanding device further including a member attached to at least one of the sections;

the expandable piece being inserted into the compartment in the initial collapsed position between the opposed portions; and tension on the member urging each set of two or more adjacent ones of the sections from its respective, substantially flat coplanar position to an intermediate position in which the sections of each set are at an angle to each other and are restrained by the predetermined shape of the expanded compartment.

2. The bag expanding device in combination with a soft bag of claim 1 in which:

the member is resilient and is attached to at least two of the sections; and the resilient member is in tension when the expandable piece is in the initial collapsed position.

3. The bag expanding device in combination with a soft bag of claim 2 in which the resilient member is in tension when the expandable piece is in the intermediate position.

4. The bag expanding device in combination with a soft bag of claim 2 further comprising:

a second resilient member attached to at least two other sections;

the second resilient member also being in tension when the expandable piece is in the initial collapsed position; and the second resilient member assisting in urging each set of two or more adjacent ones of the sections from its respective substantially flat coplanar relation to an intermediate position in which the sections of each set are at an angle to each other and are restrained by the predetermined shape of the expanded compartment.

5. The bag expanding device in combination with a soft bag of claim 2 in which:

the expanding device also includes a generally rigid insert; and the generally rigid insert is inserted inside the compartment adjacent to one of the portions between the expandable piece and the one portion.

6. The bag expanding device in combination with a soft bag of claim 5 in which:

each of the portions has a respective predetermined outline; and the generally rigid insert substantially conforms in outline to the one portion.

7. The bag expanding device in combination with a soft bag of claim 6 in which:

the soft bag has an elongated direction and has a compartment expandable to an approximately cylindrical predetermined shape; and the generally rigid insert has an elongated direction and a plurality of generally planar segments that are each foldably attached to each adjacent segment along a line generally parallel to the elongated direction to conform to the portions that in part define the approximately cylindrical predetermined shape when the expandable piece is in the intermediate position.

8. The bag expanding device in combination with a soft bag of claim 5 further comprising:

a tab extending outwardly from the expandable piece;

a slot in the generally rigid insert; and the tab engaging the slot to assist in maintaining the expandable piece in a particular relation to the generally rigid inset.

9. The bag expanding device in combination with a soft bag of claim 5 further comprising:

a second generally rigid insert; and the second generally rigid insert being inserted inside the compartment adjacent to the other opposed portion and spaced from the first generally rigid insert with the expandable piece between the two generally rigid inserts.

10. The bag expanding device in combination with a soft bag of claim 9 in which:

each of the portions has a respective predetermined outline;

the first generally rigid insert substantially conforms in outline to the one portion; and the second generally rigid insert substantially conforms in outline to the other opposed portion.

11. The bag expanding device in combination with a soft bag of claim 9 in which:

the soft bag has an elongated direction and has a compartment expandable to an approximately cylindrical predetermined shape; and both of the generally rigid inserts have an elongated direction and a plurality of generally planar segments that are each foldably attached to each adjacent segment along a line generally parallel to the elongated direction so that each of the generally rigid inserts conforms to one of the portions that in part define the approximately cylindrical predetermined shape when the expandable piece is in the intermediate position.

12. The bag expanding device in combination with a soft bag of claim 9 further comprising:

a pair of tabs;

each of the tabs extending outwardly from a generally opposed part of the expandable piece;

a first slot in the first generally rigid insert;

a second slot in the second generally rigid insert; and one of the pair of tabs engaging the first slot and the other of the pair of tabs engaging the second slot to assist in maintaining the expandable piece in a particular relation to the first and second generally rigid inserts.

13. The bag expanding device in combination with a soft bag of claim 1 in which:

the expanding device also includes a generally rigid insert; and the generally rigid insert is inserted inside the compartment adjacent to one of the portions between the expandable piece and the one portion.

14. The bag expanding device in combination with a soft bag of claim 13 in which:

each of the portions has a respective predetermined outline; and the generally rigid insert substantially conforms in outline to the one portion.

15. The bag expanding device in combination with a soft bag of claim 14 in which:

the soft bag has an elongated direction and the compartment is expandable to an approximately cylindrical predetermined shape; and the generally rigid insert has an elongated direction and a plurality of generally planar segments that are each foldably attached to each adjacent segment along a line generally parallel to the elongated direction to conform to the portions that in part define the approximately cylindrical predetermined shape when the expandable piece is in the intermediate position.

16. The bag expanding device in combination with a soft bag of claim 13 further comprising:

a tab extending outwardly from the expandable piece;

a slot in the generally rigid insert; and the tab engaging the slot to assist in maintaining the expandable piece in a particular relation to the generally rigid insert.

17. The bag expanding device in combination with a soft bag of claim 13 further comprising:

a second generally rigid insert; and the second generally rigid insert being inserted inside the compartment adjacent to the other opposed portion and spaced from the first generally rigid insert with the expandable piece between the two generally rigid inserts.

18. The bag expanding device in combination with a soft bag of claim 17 in which:

each of the portions has a respective predetermined outline;

the first generally rigid insert substantially conforms in outline to the one portion; and the second generally rigid insert substantially conforms in outline to the other opposed portion.

19. The bag expanding device in combination with a soft bag of claim 18 in which:

the soft bag has an elongated direction and the compartment is expandable to an approximately cylindrical predetermined shape; and both of the generally rigid inserts have an elongated direction and a plurality of generally planar segments that are each foldably attached to each adjacent segment along a line generally parallel to the elongated direction so that each of the generally rigid inserts conforms to one of the portions that in part define the approximately cylindrical predetermined shape when the expandable piece is in the intermediate position.

20. The bag expanding device in combination with a soft bag of claim 18 further comprising:

a pair of tabs;

each of the tabs extending outwardly from a generally opposed part of the expandable piece;

a first slot in the first generally rigid insert;

a second slot in the second generally rigid insert; and one of the pair of tabs engaging the first slot and the other of the pair of tabs engaging the second slot to assist in maintaining the expandable piece in a particular relation to the first and second generally rigid inserts.

* * * * *